United States Patent [19]

Ulanet

[11] 4,429,670

[45] Feb. 7, 1984

[54] ENGINE PROTECTION SYSTEMS

[76] Inventor: George D. Ulanet, 89 Claremont Ave., Maplewood, N.J. 07040

[21] Appl. No.: 875,100

[22] Filed: Feb. 3, 1978

[51] Int. Cl.[3] ..... F02B 77/08

[52] U.S. Cl. ..... 123/198 D; 123/198 DB; 123/198 DC

[58] Field of Search ..... 123/198 D, 198 DB, 198 DC

[56] References Cited

U.S. PATENT DOCUMENTS

| | | | |
|---|---|---|---|
| 3,241,539 | 3/1966 | Kuehn | 123/198 DC |
| 3,533,391 | 10/1970 | Lockmuller | 123/198 DB |
| 4,019,489 | 4/1977 | Cartmill | 123/198 D |

*Primary Examiner*—Ira S. Lazarus

*Attorney, Agent, or Firm*—Lawrence Rosen

[57] ABSTRACT

Internal combustion engine protection systems including visual and audible signals responsive to operative conditions of at least coolant level, engine temperatures, high and low oil pressures and, in the case of turbo chargers, to air intake pressures. An engine disabling means is operative when any of the aforegoing conditions exceed predetermined limits for a predeterminable period. Override means, effective for only a limited duration, permits emergency engine operation even if one or more of said predetermined limits have been exceeded for said predeterminable period so as to ordinarily incur engine disablement.

15 Claims, 2 Drawing Figures

ENGINE PROTECTION SYSTEMS

The invention relates to protection systems for internal combusion engines under operative conditions.

Prior systems inadequately protect any of the gasoline or diesel internal combustion engines from costly mechanical breakdown due to the operative conditions which exceed safe parameters involving, for instance, any one of, or combinations of, high and low oil pressures, coolant level, coolant temperature and air intake pressures in the case of turbo chargers.

An object of this invention is to provide a failsafe system by which to protect an internal combustion engine from costly mechanical breakdown due to aforegoing reasons.

A further object of the invention is to provide internal combustion protection means with a warning system which is responsive to operative conditions involving, for instance, any one of, or combinations of, high and low oil pressures, coolant level, coolant temperature, engine temperature and air intake pressure in the case of turbo chargers.

Another object of the invention is to provide a warning system which effects either an audible or visual signal or both.

Another object of the invention is to provide an engine disabling system which is effective to completely shut down the engine when operative conditions, for at least a predeterminable period, exceed predetermined limits with respect to anyone or more of high and low oil pressures, coolant level, coolant temperature, engine temperature and intake pressures in the case of turbo chargers.

Another object of the invention is to impose the disabling system on the warning system so that engine shut down automatically is effected when the warning signals continue for said predeterminable time.

Another object of the invention is to provide a limited duration override system, for emergency engine operation under aforenoted conditions that ordinarily incur engine disablement.

Figure 1:
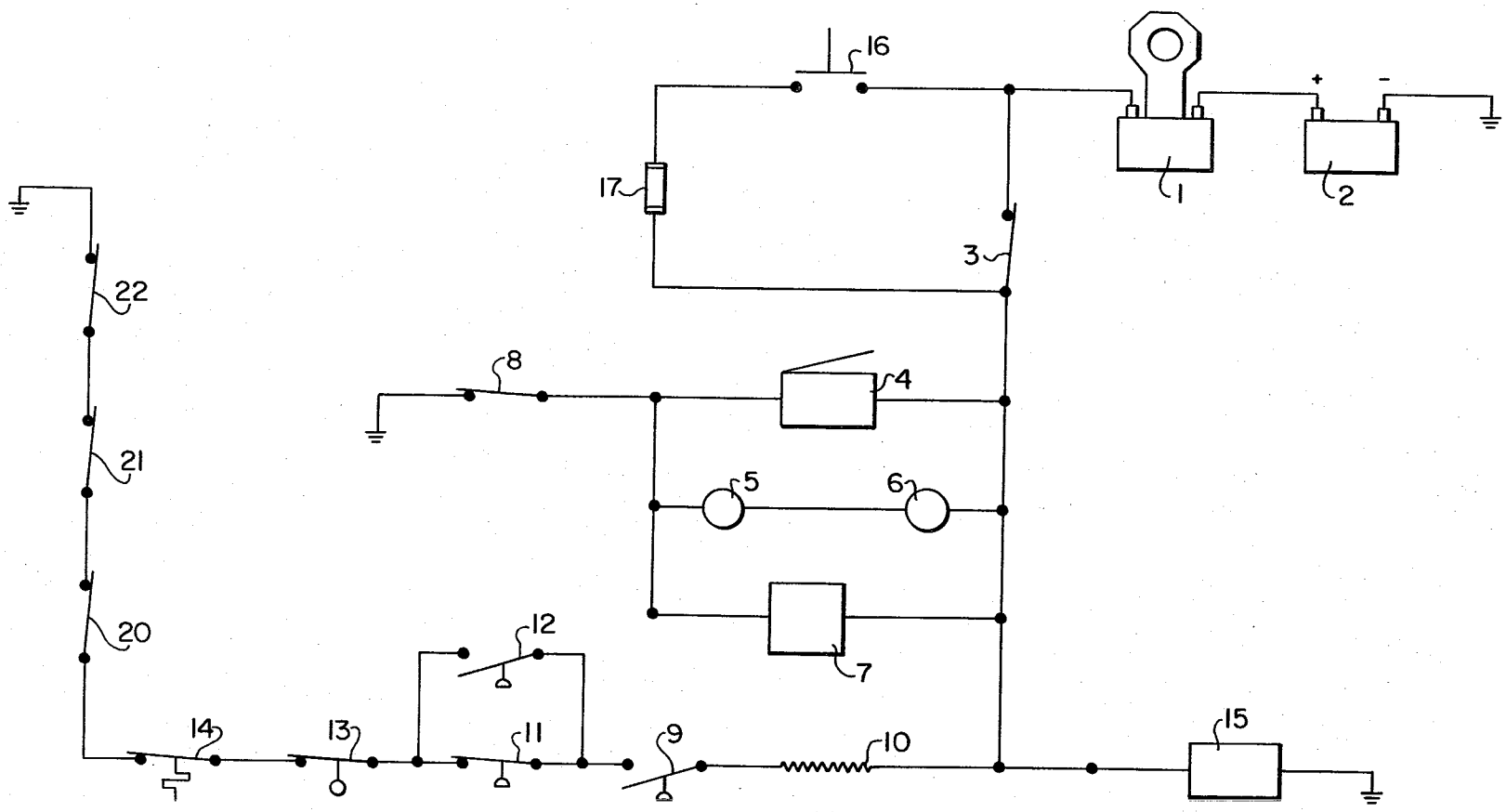

FIG. 1 relates to a protective system for a diesel engine.

Figure 2:
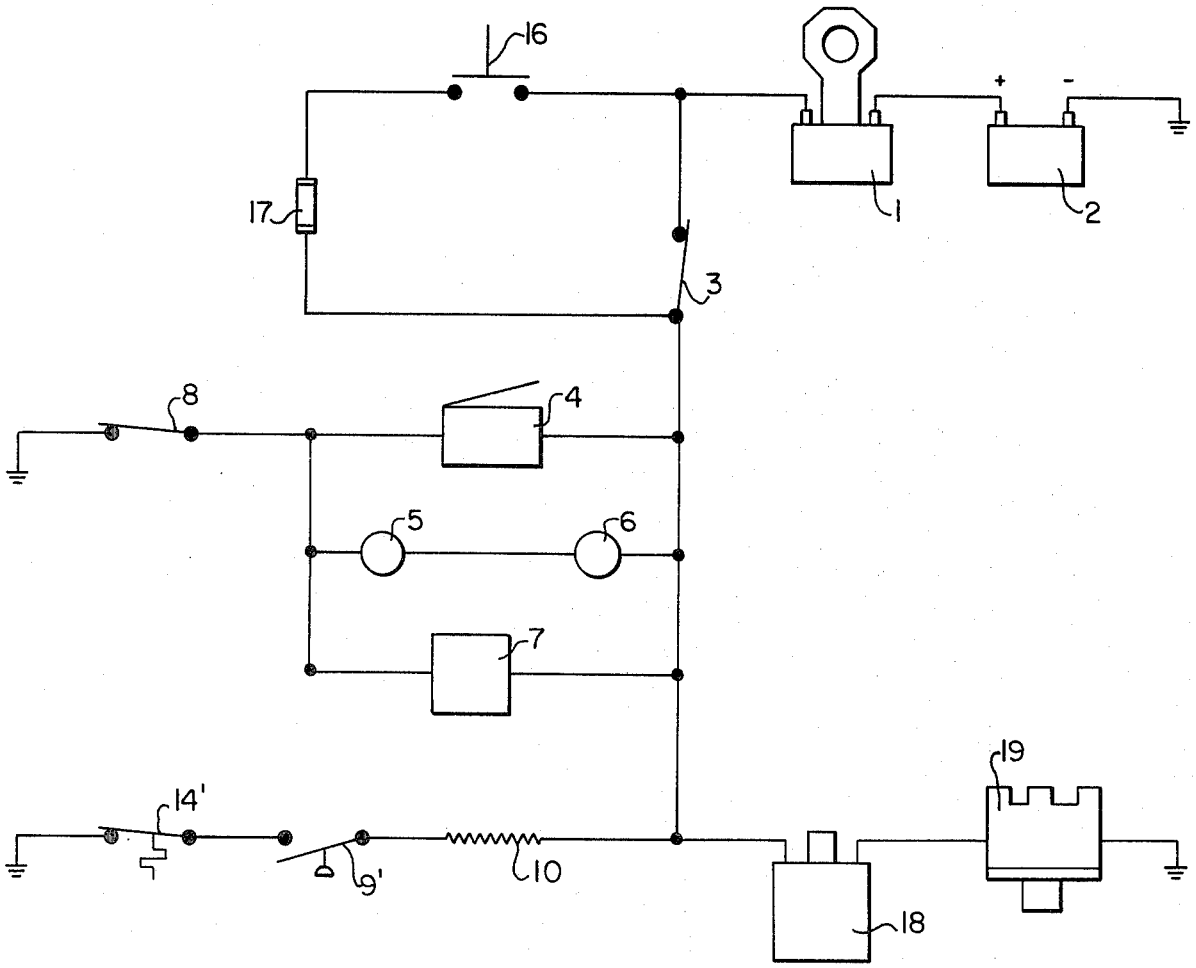

FIG. 2 relates to a protective system for a gasoline engine.

Referring now to a protective system for a diesel engine as exemplified by FIG. 1 of the drawing, the parts are illustrated as in normal disposition at the turning of the ignition key. At this instance an operative circuit is established and comprises the turned on ignition switch 1, battery 2, normally closed shut-down circuit breaker switch 3, buzzer 4, lamp 5 in series with flasher 6 and the lamp and flasher in parallel with the buzzer, shut-down circuit breaker means 7 in parallel with the buzzer and the inseries lamp and flasher, and a normally closed alarm relay switch 8 which leads to ground.

From such defined operative circuit portion, it can be seen that a warning system has been established wherein the buzzer 4 emits an audible signal and the lamp and flasher emit visible signals and that a current passes through the shut-down circuit breaker means 7; the operation of which is yet to be discussed. Obviously, the warning system can rely on only one, instead of the two disclosed visible signals.

The lead line in said defied circuit portion, leading from the circuit breaker switch 3 and into which the buzzer, flasher, and means 7 are shown tied in, then leads to alarm relay coil 10 which is in series with a normally open low RPM oil pressure sensor switch 9 which is in series connection with an in-parallel combination of normally open high RPM oil pressure sensor switch 12 and normally closed sensor switch 11, and the latter combination in series with a normally closed water level sensor switch 13 which is in series with a grounded normally closed coolant high temperature switch 14. Optionally, said latter combination may also be in series with a transmission temperature sensor switch (20), an exhaust temperature sensor switch (21), and a rear end overheat temperature switch (22). Said lead line is also shown tied to the fuel valve 15. In the protective system of a conventional diesel engine, the sensor switch 11 relates to said fuel valve, whereas in the protective system of a diesel engine with a turbo charger, the sensor switch 11 relates to sensing boost pressure change in the air intake system. In either case, the sequence of switch operation in the protective system shown and described would be identical.

In the protective system for the conventional diesel engine, after the engine starts, lube oil pressure builds up to the set point of the normally open low RPM oil pressure sensor switch 9, at which pressure said switch 9 closes to complete a circuit through sensor switch 11, water level sensor switch 13, and high temperature switch 14 and to energize the alarm relay coil 10.

Alarm relay coil 10 is operatively associated with alarm relay switch 8 and upon said energization, the relay coil operates to open said switch 8. As is obvious from the circuitry of FIG. 1, opening of the alarm relay switch 8 deactivates the buzzer 4, the lamp 5, the flasher 6 and the shut-down circuit breaker means 7.

Upon increase of engine RPM, fuel pressure builds up to the set point of the normally closed sensor switch 11 whereupon switch 11 opens. At this time if lube oil pressure has built up to the set point related to the high RPM oil pressure sensor switch 12, then the normally open switch 12 will have closed to thereby bypass switch 11 and to thereby maintain the closed circuit portion keeping the relay coil 10 energized. If, on the other hand, the lube oil pressure has not built up to the set point related to the high RPM oil pressure sensor switch 12, then the said opening of the switch 11 results in deenergizing the the alarm relay coil 10, which latter operation will cause the alarm relay switch 8 to close to thereby activate the audible and visual warning system and to cause current flow through the shut-down circuit breaker means 7.

In any case of the diesel engine protective system, any variance from the predetermined safe parameter limits of operation as relates to the aforenoted pressures, or temperatures, or levels would result in opening of the associated sensor switch to thereby deenergize the alarm coil relay, which would effect closing of the alarm relay switch to thereby activate the visual and audible alarms and to establish a current flow in the shut-down circuit breaker means 7. Such predetermined safe parameter limits obviously include both minimum and maximums of pressures, temperatures and coolant level. To prevent engine damage due to continued operation under alarm inducing conditions, the shut-down circuit breaker means 7 will function to open the shut-down circuit breaker contact 3, breaking current flow to the engine's system, including current flow to the solenoid of fuel valve 15, when said current flow through means 7 is of a predetermined duration. Thus, is the engine disabled. Such shut-down circuit breaker means are well known in the arts and the specific type relied on forms no part of this invention; for instance, a simple time delay relay means or a thermocouple means may comprise such shut-down circuit breaker means 7.

For emergency engine operation, as for instance to move a vehicle off a roadway, means are provided to override the disabling system. Manually closing the switch 16 bypasses the open shut-down circuit breaker switch 3 and reestablishes the electric circuit to permit engine operation. To prevent costly engine damage, such emergency engine operation can only be for a limited time period and such limitation is provided by the illustrated fuse 17. Thus, is provided a failsafe system.

FIG. 2 relates to a gasoline engine protective and failsafe system which monitors, disables and overrides in manner corresponding to that of the diesel engine systems of which FIG. 1 is illustrative. Identical parts with identical functions have been referenced as in FIG. 1. The conventional ignition coil 18 and distributor 19 have been illustrated for purposes of clarity but otherwise form no part of the invention. The normally open oil pressure sensor switch 9' closes, and the alarm relay coil 10 is energized when oil pressure builds up to within predetermined safe limits. The normally closed high temperature sensor switch 14' is adapted to open, and the relay coil 10 deenergized, when coolant or engine temperature rises to a predetermined set point.

It is pointed out that the protective and failsafe system of the invention is adaptable to not only on the road vehicles, but also to basically off-the-road vehicles such as earth movers, and to stationary equipment as for instance compressor systems and engine-operated pumps for transmission lines.

Also, the inventive concept as illustrated is not delimitive. Obviously, other parts of the equipment may be provided with sensors and the sensor integrated into the portion of the protective circuitry which energizes the alarm relay coil; for example, the transmission and rear-end may thus be protected against overheating.

I claim:

1. An internal combustion engine protection system having monitoring means for monitoring one or more operating parameters of the engine, alarm means and disabling means coupled to said monitoring means for indicating when at least one operative condition does not fall within predetermined safe parameters and for disabling the engine if the condition endures for a predetermined period of time, and override means for overriding said disabling means and re-enabling operation of the engine, the improvement comprising, comprehensive circuitry for said monitoring, alarm and disabling means, said circuitry comprising:

a normally open low RPM oil pressure sensor switch (9) that is adapted to close at a predetermined low oil pressure build up;

a normally open high RPM oil pressure sensor switch (12) that is adapted to close at a predetermined high oil pressure build up;

a relay coil (10) operatively associated with said switches and with a normally closed relay switch (8) in the portion of said circuitry including said disabling means;

said disabling means comprising a shut-down circuit breaker means (7) and a normally closed shut-down circuit breaker switch (3);

said circuit breaker means (7) being activated by current flow therethrough under engine operating conditions and being adapted, when subjected to said current flow for a predetermined period of time, to effect opening of said circuit breaker switch (3) to thereby disable engine operation;

each of said pressure sensor switches (9, 12) when closed completing an electric circuit to thereby energize the relay coil (10);

whereby the energized relay coil (10) effects opening of said relay switch (8) to thereby interrupt said current flow to the shut-down circuit breaker means (7) to forestall said engine disablement due to opening of the shut-down circuit breaker switch 3; and said pressure sensor switches (9, 12) being each adapted to open, when the associated oil pressure does not fall within the safe operating parameter, to thereby effect deenergizing of the relay coil (10) with the consequent closing of the relay switch (8) to thereby initiate reactivation of the shut-down circuit breaker means (7) by current flow therethrough.

2. The system of claim 1 wherein a normally closed fuel pressure sensor switch (11) is in series connection with the low RPM oil pressure sensor switch (9) and thus in the relay coil (10) energizing circuit;

said fuel pressure sensor switch being adapted to open in response to the build up of fuel pressure above a predetermined safe parameter limit;

said high RPM sensor switch being in parallel connection with the fuel pressure sensor switch;

whereby at low RPM with appropriate low fuel pressure and oil pressure above the low RPM oil pressure limit, the relay coil (10) will be activated, whereas at higher RPM with fuel pressure above said predetermined fuel pressure limit the fuel pressure sensor switch (11) will be open and the relay coil (10) will be deactivated unless the high RPM oil pressure sensor switch has been closed due to said high oil pressure build up to thereby bypass the open fuel pressure switch and thus retain the relay coil (10) energized.

3. The system of any of claims 1 or 2 wherein manually activated override circuit means bypass the shut-down circuit breaker switch (3) to enable engine operation though the circuit breaker switch (3) is open due to disablement operation in response to an operative condition outside of said safe parameters.

4. The system of claim 3 wherein means (17) in the override circuit prevents emergency engine operation for a prolonged period that would result in costly engine damage.

5. The system of any of claims 1 or 2 wherein said comprehensive circuitry inclues an alarm system;

said alarm system comprising audible means (4) in parallel connection with visible means (5, 6) and the shut-down circuit breaker means (7) being in parallel connection with each of said audible and visible means; and the combination of the alarm and circuit breaker means parallel parts (4, 5, 6, 7) being in series with the relay switch (8);

whereby upon turning the engine's ignition key the resultant current flow which activates the shut-down circuit breaker means (7) also activates the visible and audible alarm means (4, 5, 6) which are also subject to deactivation, as is the circuit breaker means (7) due to opening of the relay switch (8) upon energizing of said relay coil (10) when the appropriate aforesaid sensor switches are closed.

6. The system of claim 5 wherein the circuit portion which directly energizes the relay coil (10) includes in series connection a normally closed coolant level sensor switch (13) and a normally closed high temperature coolant sensor switch (14), each of the sensor switches (13, 14) also being effective to deenergize the relay coil (10) by breaking the circuit thereto when opened in response to the appropriate engine operative condition being outside of the predetermined safe parameter limits.

7. The system of claim 1 wherein a normally closed air boost pressure sensor switch (11) is in series connection with the low RPM oil pressure sensor switch (9) and thus in the relay coil (10) energizing circuit;

said air boost pressure sensor switch being adapted to open in response to the build up of air pressure in the air intake system above a predetermined parameter limit;

said high RPM sensor switch in parallel connection with the air boost pressure sensor switch;

whereby at low RPM with appropriate low air pressure and oil pressure above the low RPM oil pressure limit, the relay coil (10) will be activated, whereas at higher RPM with air pressure above said predetermined air pressure limit the air boost pressure sensor switch (11) will be open and the relay coil (10) will be deactivated unless the high RPM oil pressure sensor switch has been closed due to said high oil pressure build up to thereby bypass the open fuel pressure switch and thus retain the relay coil (10) energized.

8. The system of claim 7 wherein manually activated override circuit means bypass the shut-down circuit breaker switch (3) to enable engine operation though the circuit breaker switch (3) is open due to disablement operation in response to an operative condition outside of said parameters.

9. The system of claim 8 wherein means (17) in the override circuit prevents emergency engine operation for a prolonged period that would result in costly engine damage.

10. The system of any of claims 7, 8, or 9 wherein said comprehensive circuitry includes an alarm system;

said alarm system comprising audible means (4) in parallel connection with visible means (5, 6) and the shut-down circuit breaker means (7) being in parallel connection with each of said audible and visible means; and the combination of the alarm and circuit breaker means parallel parts (4, 5, 6, 7) being in series with the relay switch (8);

whereby upon turning the engine's ignition key, the resultant current flow which activates the shut-down circuit breaker means (7) also activates the visible and audible alarm means (4, 5, 6) which are also subject to deactivation, as is the circuit breaker means 7 due to opening of the relay switch (8) upon energizing of said relay coil (10) when the appropriate aforesaid sensor switches are closed.

11. The system of claim 10 wherein the circuit portion which directly energizes the relay coil (10) includes in series connection a normally closed coolant level sensor switch (13) and a normally closed high temperature coolant sensor switch (14), each of the sensor switches (13, 14) also being effective to deenergize the relay coil (10) by breaking the circuit thereto when opened in response to the appropriate engine operative condition being outside of the predetermined safe parameter limits.

12. The system of claim 6 wherein the circuit which directly energizes the relay coil (10) additionally includes in series connection a normally closed transmission temperature switch (20), a normally closed exhaust temperature switch (21) and a normally closed rear end temperature switch 22, each of these additional sensor switches (20, 21, 22) also being effective to deenergize the relay coil (10) when opened in response to the associated operative condition being outside of the predetermined safe parameter limit.

13. The system of claim 3 wherein said comprehensive circuitry includes an alarm system;

said alarm system comprising audible means (4) in parallel connection with visible means (5, 6) and the shut-down circuit breaker means (7) being in parallel connection with each of said audible and visible means; and the combination of the alarm and circuit breaker means parallel parts (4, 5, 6, 7) being in series with the relay switch (8);

whereby upon turning the engine's ignition key, the resultant current flow which activates the shut-down circuit breaker means (7) also activates the visible and audible alarm means (4, 5, 6) which are also subject to deactivation, as is the circuit breaker means 7 due to opening of the relay switch (8) upon energizing of said relay coil (10) when the appropriate aforesaid sensor switches are closed.

14. The system of claim 4 wherein said comprehensive circuitry includes an alarm system;

said alarm system comprising audible means (4) in parallel connection with visible means (5, 6) and the shut-down circuit breaker means (7) being in parallel connection with each of said audible and visible means; and the combination of the alarm and circuit breaker means parallel parts (4, 5, 6, 7) being in series with the relay switch (8);

whereby upon turning the engine's ignition key, the resultant current flow which activates the shut-down circuit breaker means (7) also activates the visible and audible alarm means (4, 5, 6) which are also subject to deactivation, as is the circuit breaker means 7 due to opening of the relay switch (8) upon energizing of said relay coil (10) when the appropriate aforesaid sensor switches are closed.

15. An internal combustion engine protection system having monitoring means for monitoring one or more operating parameters, alarm and disabling means coupled to said monitoring means for indicating when operating conditions do not lie within predetermined safe limits of said operating parameters and for disabling the engine when said operating conditions endure for a predetermined period of time, and override means for overriding said disabling means to thereby re-enable engine operation, the improvement comprising:

a normally closed high temperature coolant sensor switch (14') that is adapted to open when coolant temperature exceeds a predetermined safe limit;

a normally open low pressure oil sensor switch (9') adapted to close when oil pressure build up reaches a predetermined set point;

a relay coil (10) in series with said sensor switches and operatively associated with a normally closed relay switch (8);

an alarm system comprising audible means (4) in parallel connection with each of visible alarm means (5, 6) and shut-down circuit breaker means (7) of the disabling means;

the combination of the alarm and circuit breaker means parallel parts (4, 5, 6, 7) being in series with the normally closed relay switch (8) whereby under closed circuit conditions, with the relay switch closed, current flows through the parallel circuit parts whereupon audible and visible signals are emitted and the shut-down circuit breaker means is activated;

said relay coil (10) being energized when the engine starts and low oil pressure sensor switch (9') closes in response to build up of said oil pressure to the set point, whereby the energized relay coil effects opening of the relay switch 8 to thereby cut off the alarm signals and deactivate the shut-down circuit breaker means (7);

said relay coil 10 being deenergized when either (a) the normally closed high temperature coolant sensor switch (14') opens, when the coolant temperature exceeds the said safe limit, or (b) the closed low pressure oil sensor switch (9') opens when the oil pressure drops below said predetermined set point, whereupon in either instance of (a) or (b) the relay switch 8 closes and the emission of alarm signals is resumed and the shut-down circuit breaker means (7) is again activated;

a normally closed shut-down circuit breaker switch (3) in said disabling circuit, that is adapted to be opened when any said activation of the shut-down circuit breaker means (7) endures for a predetermined period of time to thereby completely disable engine operation;

manually actuable override circuit means (16) disposed to bypass the shut-down circuit breaker switch (3) to enable engine operation even though the said circuit breaker switch is open due to an operative condition that is not within said predetermined safe limits; and means (17) in the override circuit to prevent prolonged engine operation through the override means whereby to forestall costly engine damage.

* * * * *